United States Patent [19]

Ishizuka

[11] 4,174,931

[45] Nov. 20, 1979

[54] VANE FOR ROTARY COMPRESSOR

[75] Inventor: Yutaka Ishizuka, Konan, Japan

[73] Assignee: Diesel Kiki Company, Ltd., Tokyo, Japan

[21] Appl. No.: 860,400

[22] Filed: Dec. 13, 1977

[30] Foreign Application Priority Data

Dec. 17, 1976 [JP] Japan ..... 51-169994[U]

[51] Int. Cl.[2] ..... F04C 29/00

[52] U.S. Cl. ..... 418/259; 418/238; 418/269

[58] Field of Search ..... 418/269, 268, 267, 266, 418/259, 236, 238, 113, 124, 123, 122

[56] References Cited

U.S. PATENT DOCUMENTS

| | | | |
|---|---|---|---|
| 2,839,007 | 6/1958 | Benedek | 418/236 |
| 3,076,415 | 2/1963 | Farron | 418/268 X |

FOREIGN PATENT DOCUMENTS

| | | | |
|---|---|---|---|
| 527453 | 5/1955 | Italy | 418/269 |
| 252 | of 1873 | United Kingdom | 418/268 |

*Primary Examiner*—Leonard E. Smith

*Attorney, Agent, or Firm*—David G. Alexander

[57] ABSTRACT

A rotary compressor comprises a cylinder in which a rotor is eccentrically disposed. A plurality of generally rectangular, radially extending vanes are slidably disposed in slots in the rotor and sealingly engage the inner wall of the cylinder. Rotation of the rotor and vanes causes compression of refrigerant gas or the like trapped between adjacent vanes and discharge of the gas from the compressor. The radially outer edges of the vanes which engage the cylinder wall are curved, and the leading and trailing surfaces near the radially outer edges of the vanes are cut away to prevent sticking of the vanes in the slots due to deformation of the edges of the vanes after an extended period of use.

10 Claims, 5 Drawing Figures

VANE FOR ROTARY COMPRESSOR

BACKGROUND OF THE INVENTION

The present invention relates to a vane for a rotary compressor.

Rotary compressors for air conditioning systems and the like are widely used due to their compact configuration and vibration-free operation. Such compressors generally comprise a cylinder in which a rotor is eccentrically disposed. A plurality of generally radially extending vanes are disposed in slots formed in the rotor and sealingly engage the inner surface of the cylinder due to centrifugal force and outlet gas pressure. The change in volume of fluid chambers defined between the vanes upon rotation of the rotor is utilized to compress the gas. Refrigerant fluid or the like is introduced into the cylinder at a position where the volume of the fluid chambers is high. A discharge port is provided at a position where the volume of the fluid chambers is low. The decrease in volume serves to compress the refrigerant and force the same out the discharge port.

In order to maximize the sealing efficiency between the edges of the vanes and the inner wall of the cylinder, the vanes are somewhat offset and the edges of the vanes are curved. However, since such vanes are generally made of a soft metal such as an aluminum alloy, impact of the vanes against the cylinder wall upon start-up of the compressor eventually causes the edges of the vanes to deform. The edges of the vanes are smashed so that the thickness of the edge portions exceeds the width of the slots in the rotor. As a result, the vanes tend to stick in the slots, causing poor efficiency and erratic operation of the compressor.

SUMMARY OF THE INVENTION

The present invention overcomes the above described drawback of the prior art by providing an improved compressor vane in which the radially outer edge portion is cut away to such an extent that deformation of the vane upon prolonged use will not result in the thickness of the edge portion exceeding the width of the rotor slot in which the vane is slidably received. The amount which is cut away is optimally selected so that the increase in radially inward force of the compressed gas on the vane due to the cutout is negligible.

It is an object of the present invention to provide a vane for a rotary compressor which will not stick in a rotor slot in which it is slidably received even after prolonged use and deformation of the edge of the vane.

It is another object of the present invention to provide a vane for a rotary compressor of improved sealing efficiency upon prolonged use.

It is another object of the present invention to provide a generally improved vane for a rotary compressor.

Other objects, together with the foregoing, are attained in the embodiments described in the following description and illustrated in the accompanying drawing.

DESCRIPTION OF THE PREFERRED EMBODIMENTS

Figure 1:
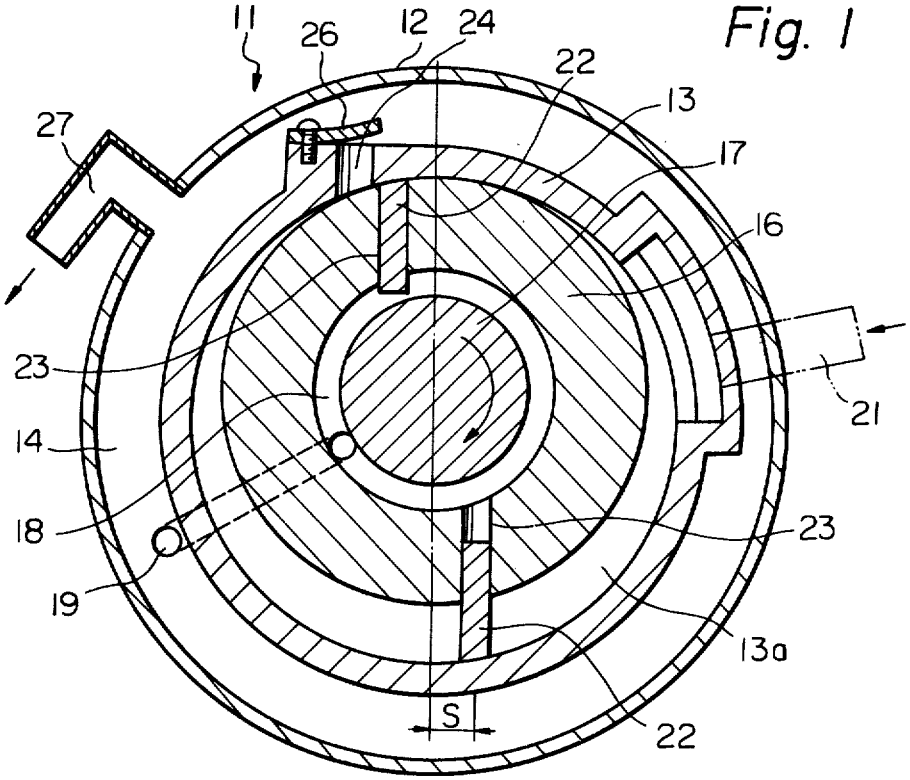
FIG. 1 is a transverse sectional view of a rotary compressor comprising vanes embodying the present invention.

While the rotary compressor vane of the invention is susceptible of numerous physical embodiments, depending upon the environment and requirements of use, substantial numbers of the herein shown and described embodiments have been made, tested and used, and all have performed in an eminently satisfactory manner.

Referring now to the drawing, a rotary compressor of the present invention is generally designated by the reference numeral 11 and comprises a cylindrical housing 12. A cylinder 13 is provided coaxially within the housing 12 with an annular space constituting a discharge chamber 14 defined between the outer wall of the cylinder 13 and the inner wall of the housing 12. The cylinder 13 is formed with a circular cylindrical bore 13*a*. A rotor 16 is fixed on a rotor shaft 17 for unitary clockwise rotation within the bore 13*a*. Although both the rotor shaft 17 and rotor 16 are circular cylindrical, they are offset from the axis of the bore 13*a*. In other words, the rotor 16 is eccentrically rotatably supported in the cylinder 13 and is tangent to the uppermost portion of the inner wall of the cylinder 13 defining the bore 13*a*. An annular chamber 18 is defined between the rotor shaft 17 and rotor 16 and communicates with the discharge chamber 14 through a passageway 19. End walls which sealing close the housing 12 and cylinder 13 and rotatably support the rotor shaft 17 and rotor 16 are provided but are not shown in the drawing.

Generally rectangular vanes 22 are slidably disposed in generally radial slots 23 formed completely through the rotor 16. Upon rotation of the rotor 16, the radially outer edges of the vanes 22 are urged into sealing engagement with the inner wall of the cylinder 13 by a combination of centrifugal force and fluid discharge pressure introduced into the chamber 18 through the passageway 19. The fluid pressure in the chamber 18 acts on the inner edges of the vanes 22, forcing the same outwardly so that the radially outer edges thereof sealingly engage the cylinder 16.

The vanes 22 partition the crescent shaped space between the rotor 16 and cylinder 13 into two fluid chambers (not designated) which vary in volume in accordance with the position of the rotor 16 and vanes 22. An inlet port 21 leads into the bore 13*a* at a position where the fluid chambers increase in volume. An outlet port 24 connects the bore 13*a* to the discharge chamber 14 at a position where the volume of the fluid chambers decreases. A flapper valve 26 is provided at the outlet port 24 to prevent reverse flow through the compressor 11. In operation, rotation of the rotor 16 causes fluid introduced at the inlet port 21 to be compressed in the cylinder 13 and forced into the discharge chamber 14 from which it is discharged form the compressor 11 through a discharge port 27. The high pressure in the discharge chamber 14 maintains the vanes 22 in sealing engagement with the cylinder 13 as described above. In order to increase the sealing effect of the vanes 22 against the inner wall of the cylinder 13, the vanes 22 are not diametrically opposed but are displaced opposite to the direction of rotation of the rotor 16 by a distance S.

Figure 2:
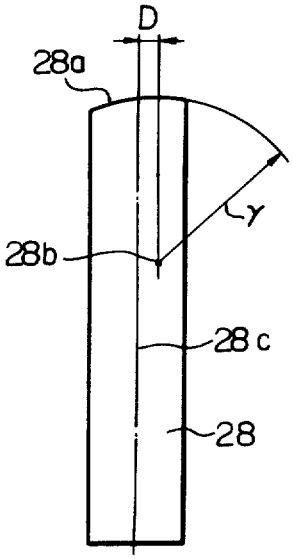
Fig. 2 PRIOR ART
FIG. 2 is a sectional view of a prior art vane.

A prior art vane 28 which heretofore was used in place of the present vanes 22 is illustrated in FIG. 2. During operation of the compressor 11, the pressurized fluid in the fluid chambers exerts a radially inward force of 20–30 kg/cm$^2$ on the vanes. To ensure good sealing engagement of the vanes 28 with the cylinder 13 in spite of this inward force, the radially outer edge of the vane 28, designated as 28*a*, is curved. The radius of curvature of the edge 28*a* is designated as r. The center of curvature of the edge 28*a* is designated as 28*b* and is displaced by a distance D ahead of a center 28*c* of the vane 28 in the direction of movement thereof.

Figure 3:
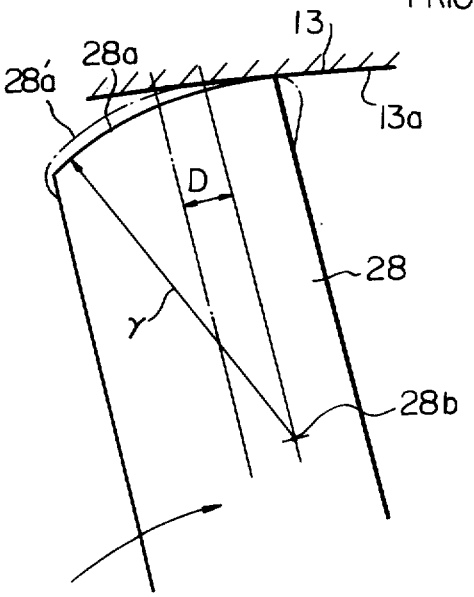
Fig. 3 PRIOR ART
FIG. 3 is a diagrammatic sectional view of the prior art vane illustrating deformation thereof after prolonged use.

FIG. 3 illustrates the vane 28 after a prolonged period of use. During start-up of the compressor 11 when the centrifugal force on the vanes 28 and the pressure in the discharge chamber 14 are low, the vanes 28 fly outwardly into smashing engagement with the inner wall of the cylinder 13. Since the vanes 28 are made of a relatively soft material such as an alminum alloy, the edges 28*a* tend to deform as indicated at 28*a'*. It will be noted that the thickness of the edge 28*a'* is greater than that of the main body of the vane 28 and also greater than the width of the slots 23. For this reason, when the vanes 28 are pressed completely into the slots 23 at the upper portion of the cylinder 13, they stick in the slots 23 and seriously degrade the operation of the compressor 11.

Figure 4:
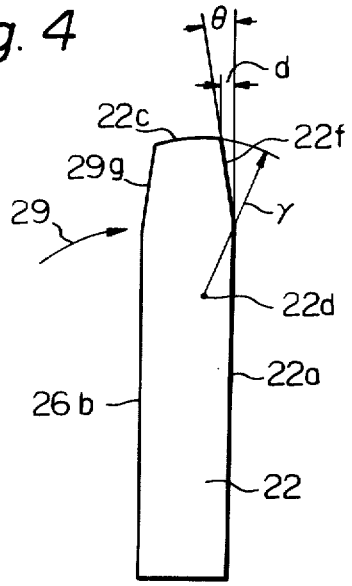
FIG. 4 is a sectional view of an improved vane embodying the present invention.
Figure 5:
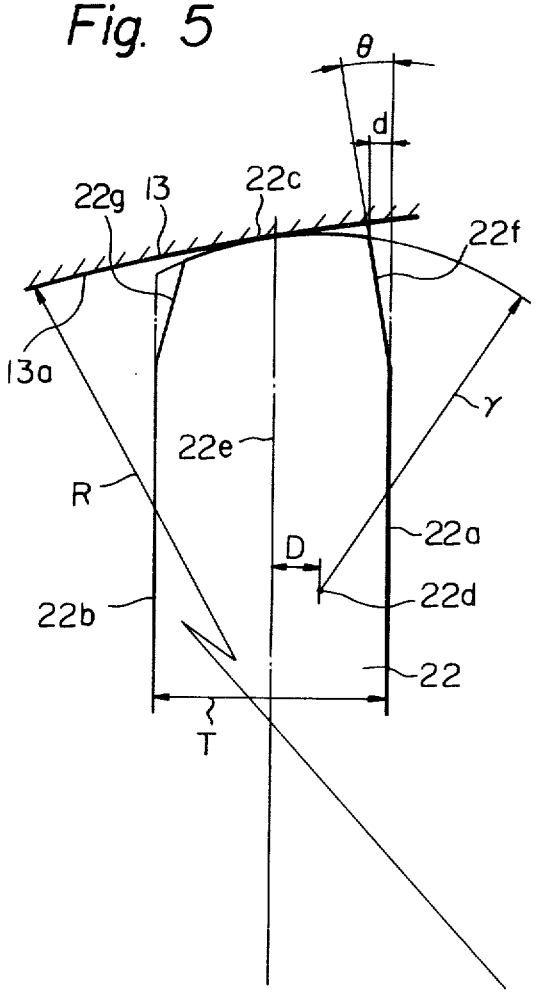
FIG. 5 is an enlarged sectional view of an edge portion of the present vane.

FIG. 4 shows the improved vane 22 of the present invention which is generally rectangular in cross section and has a leading surface 22*a* and a trailing surface 22*b* in the direction of movement of the vane 22 which is indicated by an arrow 29. The vane 22 has a radially outer edge 22*c* which is curved in a manner similar to the vane 28. More specifically, the edge 22*c* has a radius of curvature r and a center of curvature 22*d* which is displaced by the distance D from the center 22*e* of the vane 22. This is illustrated in enlarged form in FIG. 5. Designated as R is the radius of the cylinder 13.

The radially outer portion of the leading surface 22*a*, which is designated as 22*f*, is cut away as illustrated. The outer portion 22*f* is preferably flat, and makes an angle $\theta$ with the leading surface 22*a*. The distance from the upper corner (not designated) of the portion 22*f* to the leading surface 22*a* measured along the inner wall of the cylinder 13 is designated as d.

The angle $\theta$ is preferably between 3° and 15°, and is selected so that deformation of the edge 22*c* in the manner illustrated in FIG. 3 will not cause the thickness of the outer edge 22*c* to exceed the thickness of the body of the vane 22. In other words, the circumferential expansion of the edge 22*c* due to smashing thereof against the inner wall of the cylinder 13 will not exceed the distance d. This positively prevents sticking of the vane 22 in the respective slot 23. The angle $\theta$ is selected to be sufficiently small that the component of fluid pressure acting on the portion 22*f* in the radially inward direction is negligible, and will not affect the sealing of the edge 22*c* against the cylinder 13 to any noticable extent.

Although in certain applications, due to the displacements S and D, it is sufficient to cut away only the portion 22*f* at the leading surface 22*a* of the vane 22, a radially outer portion 22*g* may be cut away at the trailing surface 22*b* if required in a similar manner.

Various practical values of the parameters described hereinabove are as follows, where the thickness T of the vane 22 is 5 mm: $\theta=10°$; d=0.5 mm; r=6 mm; D=1 mm; R=40 mm.

In summary, it will be seen that the present invention positively prevents vanes in a rotary compressor from sticking in the slots in which they are radially slidably received and thereby degrading the performance of the compressor. Various modifications will become possible for those skilled in the art after receiving the teachings of the present disclosure without departing from the scope thereof. For example, although the bore 13*a* of the cylinder 13 is shown and described as being circular cylindrical, it may have any other suitable cross-section.

What is claimed is:

1. In a rotary vane compressor, a generally rectangular vane having a leading surface and trailing surface, a radially outer portion of the leading surface being cut away by a predetermined amount;

the radially outer portion of the leading surface being flat and making an angle $\theta$ with the leading surface;

the angle $\theta$ being between 3° and 15°.

2. A vane as in claim 1 having a curved radially outer edge.

3. A vane as in claim 2, in which the outer edge has a center of curvature which is displaced from a center of the vane toward the leading surface by a predetermined amount.

4. A vane as in claim 1, in which a radially outer portion of the trailing surface is cut away by a predetermined amount.

5. A vane as in claim 4, in which the radially outer portion of the trailing surface is flat and makes an angle with the trailing surface.

6. A vane as in claim 4, in which the radially outer portion of the trailing surface is flat and makes an angle between 3° and 15° with the trailing surface.

7. In a rotary vane compressor, a generally rectangular vane having a leading surface and a trailing surface, a radially outer portion of the leading surface being cut away by a predetermined amount;

a radially outer portion of the trailing surface being cut away by a predetermined amount;

the radially outer portion of the trailing surface being flat and making an angle $\theta$ with the trailing surface;

the angle $\theta$ being between 3° and 15°.

8. A vane as in claim 7, in which the radially outer portion of the leading surface is flat and makes an angle with the leading surface.

9. A vane as in claim 7, having a curved radially outer edge.

10. A vane as in claim 9, in which the outer edge has a center of curvature which is displaced from a center of the vane toward the leading surface by a predetermined amount.

* * * * *